US008197737B2

(12) United States Patent
Williams

(10) Patent No.: US 8,197,737 B2
(45) Date of Patent: Jun. 12, 2012

(54) REINFORCED STRIPPER RUBBER BODY AND METHOD OF MAKING SAME

(75) Inventor: John R. Williams, Georgetown, TX (US); Theresa J. Williams, legal representative, Georgetown, TX (US)

(73) Assignee: Hampton IP Holding, Co.

( * ) Notice: Subject to any disclaimer, the term of this patent is extended or adjusted under 35 U.S.C. 154(b) by 63 days.

(21) Appl. No.: 12/798,164

(22) Filed: Mar. 30, 2010

(65) Prior Publication Data

US 2010/0213635 A1 Aug. 26, 2010

Related U.S. Application Data

(62) Division of application No. 12/082,884, filed on Apr. 15, 2008, now Pat. No. 7,717,168.

(51) Int. Cl.
*B29C 43/10* (2006.01)

(52) U.S. Cl. ..... 264/255; 264/250

(58) Field of Classification Search ..... 264/241, 264/250, 255, 257, 259
See application file for complete search history.

(56) References Cited

U.S. PATENT DOCUMENTS

| | | | | |
|---|---|---|---|---|
| 4,480,843 | A * | 11/1984 | Springer et al. | 277/343 |
| 2005/0098324 | A1 * | 5/2005 | Gano | 166/384 |
| 2005/0183856 | A1 * | 8/2005 | Williams | 166/84.3 |
| 2006/0108015 | A1 * | 5/2006 | Price et al. | 138/89 |

* cited by examiner

*Primary Examiner* — Christina Johnson
*Assistant Examiner* — Xue Liu
(74) *Attorney, Agent, or Firm* — David O. Simmons

(57) ABSTRACT

A reinforced stripper rubber assembly with a stripper rubber body including a drillstring engaging portion having a drillstring bore extending axially therethrough. The drillstring engaging portion of the stripper rubber body is made from an elastomeric material, has an inner surface that engages a drillstring when the drillstring is dispose therein and has a reinforcing insert receiving recess within an exterior surface thereof extending at least partially around the drillstring bore. A reinforcing insert is disposed within the reinforcing insert receiving recess. The reinforcing insert includes an elastomeric material bonded to the stripper rubber body within the reinforcing insert receiving recess. A support structure is disposed within a support structure engaging portion of the stripper rubber body. The support structure includes a central opening generally aligned with the drillstring bore thereby allowing the drillstring to pass jointly through the central opening and the drillstring bore.

20 Claims, 3 Drawing Sheets

REINFORCED STRIPPER RUBBER BODY AND METHOD OF MAKING SAME

CROSS REFERENCE TO RELATED APPLICATIONS

This divisional patent application claims priority from U.S. Non-Provisional patent application having Ser. No. 12/082,884, filed Apr. 15, 2008 now U.S. Pat. No. 7,717,168 entitled "REINFORCED STRIPPER RUBBER BODY AND METHOD OF MAKING SAME", which has a common applicant herewith and is being incorporated herein in its entirety by reference.

FIELD OF THE DISCLOSURE

Embodiments of the present invention relate to a long-lasting, deformation-resistant, rubber or elastomer-based (i.e., universally referred to as elastomeric) seal having a configuration for dynamically sealing against tubular members or drillstring components (i.e., drillstrings) movable longitudinally through the seal. In particular, embodiments of the present invention relate to stripper rubbers, support structures (i.e., inserts), and insert assemblies, for stripper rubbers used with rotating control heads, rotating blowout preventers, diverter/preventers and the like, in oil, gas, coal-bed methane, water or geothermal wells.

BACKGROUND

Oil, gas, water and geothermal wells are typically drilled with a drill bit connected to a hollow drill string which is inserted into a well casing cemented in the well bore. A drilling head is attached to the well casing, wellhead or to associated blowout preventer equipment, for the purposes of sealing the interior of the well bore from the surface and facilitating forced circulation of drilling fluid through the well while drilling or diverting drilling fluids away from the well. Drilling fluids include, but are not limited to, water, steam, drilling muds, air, and other gases.

In the forward circulation drilling technique, drilling fluid is pumped downwardly through the bore of the hollow drill string, out the bottom of the hollow drill string and then upwardly through the annulus defined by the drill string and the interior of the well casing, or well bore, and subsequently out through a side outlet above the well head. In reverse circulation, a pump impels drilling fluid through a port, down the annulus between the drill string and the well casing, or well bore, and then upwardly through the bore of the hollow drill string and out of the well.

Drilling heads typically include a stationary body, often referred to as a bowl, which carries a rotatable spindle such as a bearing assembly, rotated by a kelly apparatus or top drive unit. One or more seals or packing elements, often referred to as stripper packers or stripper rubbers, is carried by the spindle to seal the periphery of the kelly or the drive tube or sections of the drill pipe, whichever may be passing through the spindle and the stripper rubber, and thus confine or divert the core pressure in the well to prevent the drilling fluid from escaping between the rotating spindle and the drilling string.

As modern wells are drilled ever deeper, or into certain geological formations, very high temperatures and pressures may be encountered at the drilling head. These rigorous drilling conditions pose increased risks to rig personnel from accidental scalding, burns or contamination by steam, hot water and hot, caustic well fluids. There is a danger of serious injury to rig workers when heavy tools are used to make a stripper rubber connection at the drilling head. The connection should be made quickly and achieve a fluid tight seal.

Rotating blowout preventers and diverters are well known to those of ordinary skill in the art of well pressure control. Rotation of the diverter/preventer is facilitated by a sealing engaged bearing assembly through which the drill string rotates relative to the stationary bowl or housing in which the bearing assembly is seated. Typically, a rubber O-ring seal, or similar seal, is disposed between the stripper rubber and the bearing assembly to improve the fluid-tight connection between the stripper rubber and the bearing assembly.

Pressure control is achieved by means of one or more stripper rubbers connected to the bearing assembly and disposed around the drill string. At least one stripper rubber rotates with the drill string. Stripper rubbers typically taper downward and include rubber or other elastomeric substrate so that the downhole pressure pushes up on the rubber, pressing the rubber against the drill string to achieve a fluid-tight seal. Stripper rubbers often further include a metal insert that provide support for bolts or other attachment means and which also provide a support structure to minimize deformation of the rubber cause by down hole pressure forces acting on the rubber.

Stripper rubbers are connected or adapted to equipment of the drilling head to establish and maintain the pressure control seal around a down hole tubular (i.e., a drill string). It will be understood by those skilled in the art that a variety of means are used to attach a stripper rubber to associated drilling head equipment. Such attachment means include bolting from the top, bolting from the bottom, screwing the stripper rubber directly onto the equipment via cooperating threaded portions on the top of the stripper rubber and the bottom of the equipment, and clamps.

It will be understood that, depending on the particular equipment being used at a drilling head, a stripper rubber at one well may be connected to equipment specific to that well while at another well a stripper rubber is connected to different equipment. For example, at one well the stripper rubber may be connected to the bearing assembly while at another well the stripper rubber may be connected to an inner barrel or an accessory of the drilling head. While the present disclosure is made here in relation to connecting the stripper rubber to the bearing assembly, it will be evident that the disclosure contemplates connection of the stripper rubber to any selected equipment of the drilling head.

It is common practice to tighten the bolts or screws of the connection with heavy wrenches and sledge hammers. The practice of using heavy tools to tighten a bolt, for example, can result in over-tightening, to the point where the threads or the bolt head become stripped. The results of over-tightening include stripped heads, where the bolt or screw cannot be removed, or stripped threads, where the bolt or screw has no grip and the connection fails. Both results are undesirable.

Even worse, vibration and other drilling stresses can cause bolts or screws to work themselves loose and fall out. If one or more falls downhole, the result can be catastrophic. The drill bit can be ruined. The entire drillstring may have to tripped out, and substantial portions replaced, including the drill bit. If the well bore has been cased, the casing may be damaged and have to be repaired.

Drilling head assemblies periodically need to be disassembled to replace stripper rubbers or other parts, lubricate moving elements and perform other recommended maintenance. In some circumstances, stripped or over tightened bolts or screws make it very difficult if not impossible to disengage the stripper rubber from the drilling head assembly to perform recommended maintenance or parts replacement.

Therefore, a stripper rubber assembly that that overcomes above-mentioned and other known and yet to be discovered drawbacks associated with prior art stripper rubber assemblies individually and, optionally, in combination with oil field drilling equipment (e.g., rotating control head, rotating blowout preventor and/or the like) would be advantageous, desirable and useful.

SUMMARY OF THE DISCLOSURE

In view of the foregoing, the present invention, through one or more of its various aspects, embodiments and/or specific features or sub-components, is thus intended to bring out one or more of the advantages that will be evident from the disclosures made herein. A stripper rubber assembly configured in accordance with the present invention more robustly accommodates the damaging effect of drill pipe (i.e., downhole tubulars) being inserted into and withdrawn from a stripper rubber assembly and having pressure from within a well exerted thereon. More specifically, such a stripper rubber assembly includes a stripper rubber body having multiple discrete areas of different resilient material compositions. A first one of the areas is preferentially configured for resiliency (i.e., flexing to seal against a drill pipe and to allow a drill pipe to pass through therethrough) and a second one of the areas is preferentially configured for rigidity (i.e., resisting the compressive forces exerted by down hole fluids on the exterior surface of the stripper rubber body). In this manner, a stripper rubber assembly in accordance with an embodiment of the present invention has areas thereof that are preferentially configured for accommodating different types of forces exerted on the stripper rubber body.

In one embodiment of the present invention, a reinforced stripper rubber assembly comprises a stripper rubber body, a reinforcing insert and a support structure. The stripper rubber body includes a drillstring engaging portion having a drillstring bore extending axially therethrough. The drillstring engaging portion of the stripper rubber body is made from an elastomeric material, has an inner surface that engages a drillstring when the drillstring is dispose within the drillstring bore and has a reinforcing insert receiving recess within an exterior surface thereof extending at least partially around the drillstring bore. The reinforcing insert is disposed within the reinforcing insert receiving recess such that the reinforcing insert receiving recess is substantially filled by the reinforcing insert. The reinforcing insert includes an elastomeric material bonded to the stripper rubber body within the reinforcing insert receiving recess. The support structure is at least partially disposed within a support structure engaging portion of the stripper rubber body. The support structure includes a central opening generally aligned with the drillstring bore thereby allowing the drillstring to pass jointly through the central opening and the drillstring bore.

In another embodiment of the present invention, a reinforced stripper rubber assembly comprises a stripper rubber body, a reinforcing insert and support structure. The stripper rubber body includes a drillstring engaging portion having a drillstring bore extending axially therethrough. The drillstring engaging portion of the stripper rubber body is made from an elastomeric material, has an inner surface that engages a drillstring when the drillstring is dispose within the drillstring bore and has a reinforcing insert receiving recess within an exterior surface thereof extending entirely around the drillstring bore. The reinforcing insert is disposed within the reinforcing insert receiving recess. The reinforcing insert includes an elastomeric material bonded to the stripper rubber body within the reinforcing insert receiving recess and at least one elongated length of a woven material encapsulated within the elastomeric material of the reinforcing insert. The support structure is at least partially disposed within an upper end portion of the stripper rubber body. The support structure includes a central opening generally aligned with the drillstring bore thereby allowing a drillstring to pass jointly through the central opening and the drillstring bore.

In another embodiment of the present invention, a method for making a reinforced stripper rubber assembly comprises a plurality of operations. An operation is performed for molding a stripper rubber body from an elastomeric material within a first stripper rubber body mold. Molding the stripper rubber body includes forming a drillstring engaging portion having a drillstring bore extending axially therethrough, having a reinforcing insert receiving recess within an exterior surface thereof extending entirely around the drillstring bore and having an inner surface that engages a drillstring when the drillstring is dispose within the drillstring bore. An operation is performed for filling the reinforcing insert receiving recess with an elastomeric material after removing the stripper rubber body from the first stripper rubber body mold. An operation is performed for situating the stripper rubber body in a second stripper rubber body mold such that the stripper rubber body and the elastomeric material disposed in the reinforcing insert receiving recess are jointly contained within a mold cavity thereof having a shape corresponding to a finished shape of the reinforced stripper rubber body. An operation is performed for heating the second stripper rubber body mold after situation the stripper rubber body therein to cause the elastomeric material within the reinforcing insert receiving recess to become bonded to the elastomeric material of the stripper rubber body thereby providing a reinforcing insert bonded to the stripper rubber body within the reinforcing insert receiving recess.

In another embodiment of the present invention, a second method for making a reinforced stripper rubber assembly in accordance with an embodiment of the present invention includes a plurality of operations. An operation is performed for forming a stripper rubber body made from an elastomeric material, which may include molding the stripper rubber body and, optionally machining the reinforcing insert receiving recess in the stripper rubber body. The stripper rubber body includes a drillstring engaging portion having a drillstring bore extending axially therethrough, having a reinforcing insert receiving recess within an exterior surface thereof extending entirely around the drillstring bore and having an inner surface that engages a drillstring when the drillstring is dispose within the drillstring bore. An operation is then performed for filling the reinforcing insert receiving recess with an elastomeric material. Thereafter an operation is performed for wrapping a compression inducing material around the exterior surface of the stripper rubber body and around the elastic material within the reinforcing insert receiving recess, followed by performed an operation for heating the wrapped stripper rubber body.

These and other objects, embodiments, advantages and/or distinctions of the present invention will become readily apparent upon further review of the following specification, associated drawings and appended claims.

BRIEF DESCRIPTION OF THE DRAWINGS

The present disclosure is further made in the detailed description that follows, by reference to the noted drawings, by way of non-limiting examples of embodiments in which like reference numerals represent similar parts throughout several views of the drawings, and in which.

DETAILED DESCRIPTION

Figure 1:
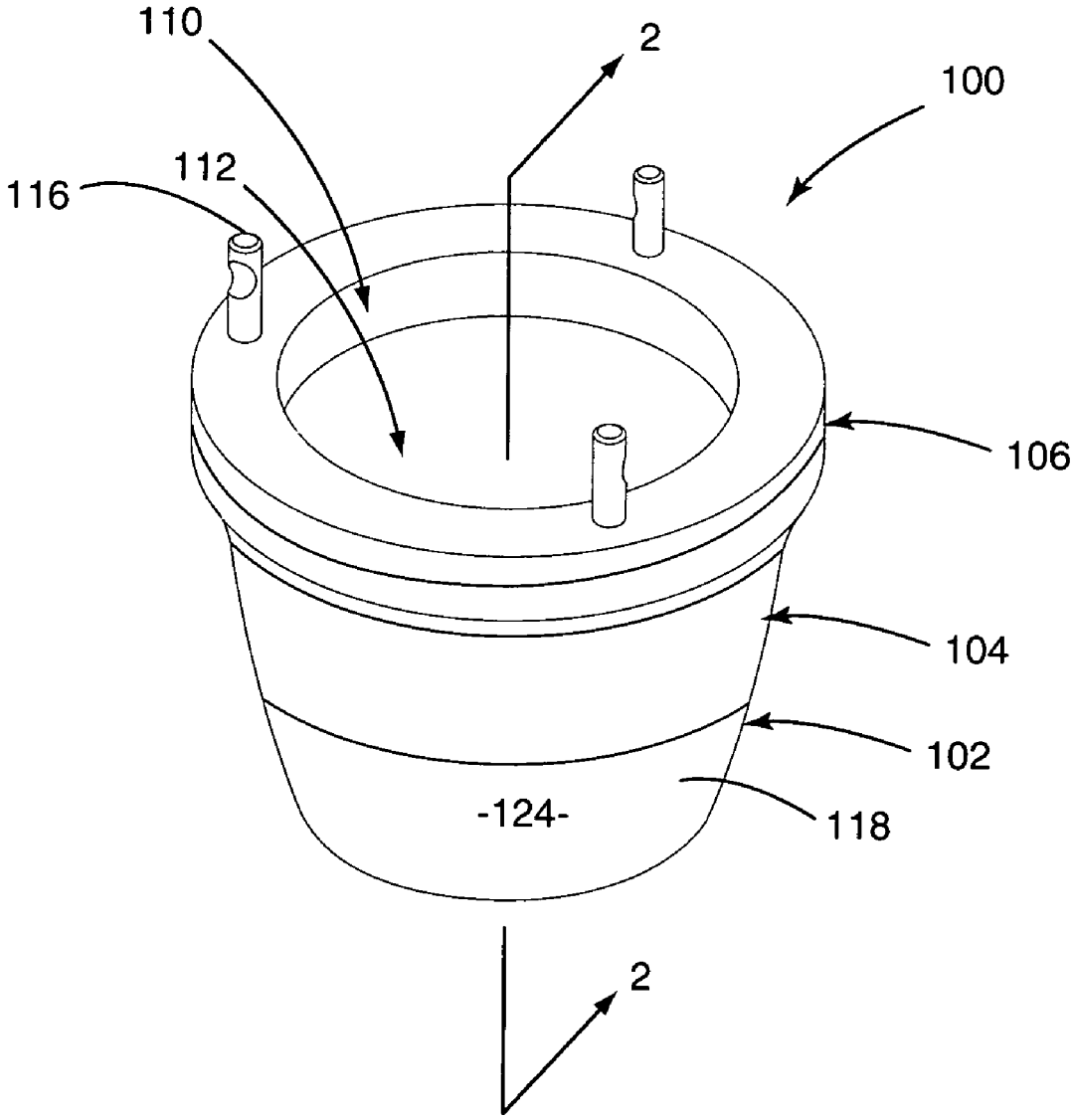
FIG. 1 is a perspective view showing a reinforced stripper rubber assembly in accordance with an embodiment of the present invention.
Figure 2:
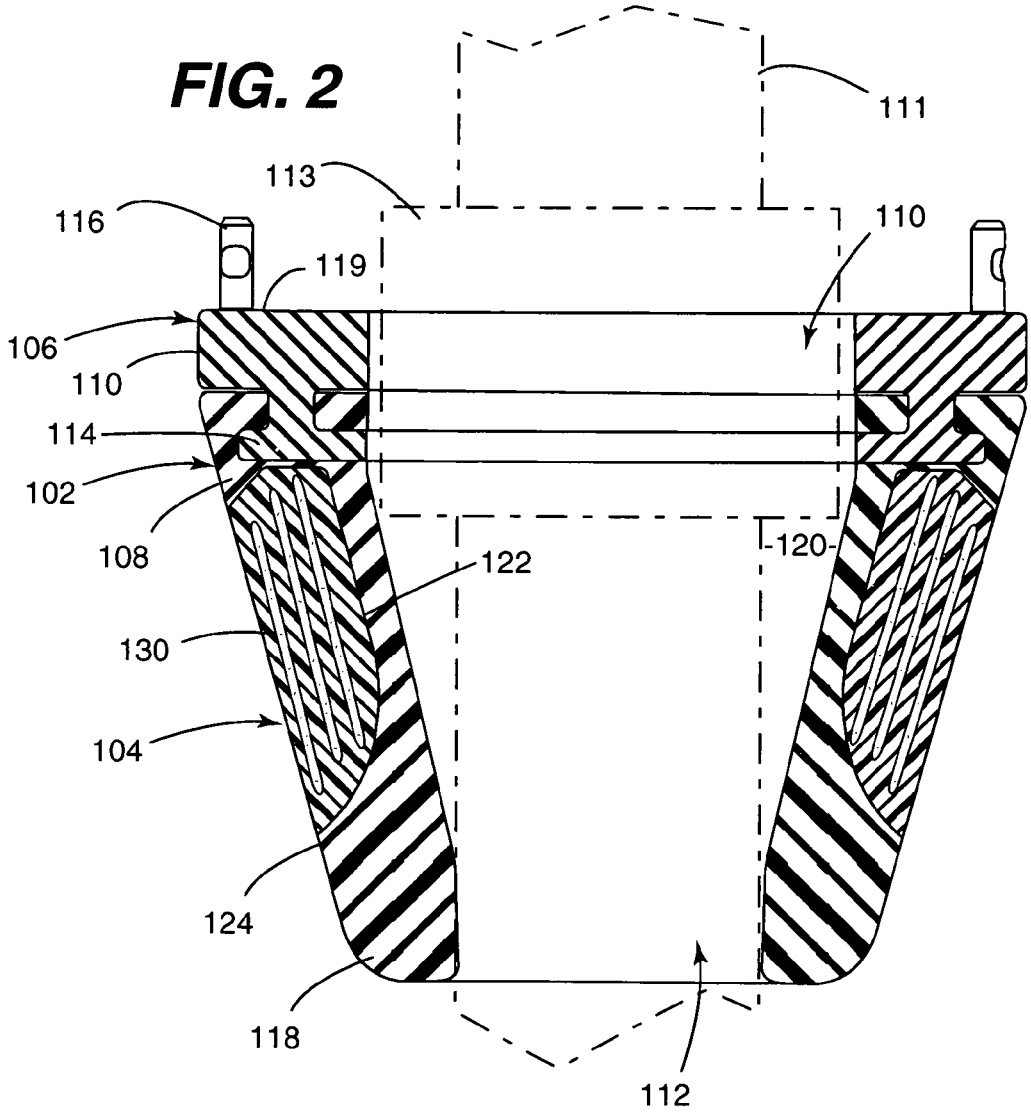
FIG. 2 is a cross-sectional view taken along the line 2-2 in FIG. 1.

Referring to FIGS. 1 and 2, a reinforced stripper rubber assembly 100 in accordance with an embodiment of the present invention includes a stripper rubber body 102, a reinforcing insert 104, and a support structure 106. The support structure 106 is fully or partially disposed within a support structure engaging portion 108 of the stripper rubber body 102. A central opening 110 of the support structure 106 is generally aligned with a drillstring bore 112 of the stripper rubber body 102 thereby allowing a drillstring 111 to pass jointly through the central opening 110 and the drillstring bore 112. The stripper rubber body 102 is configured to seal on the drillstring 111 and to expansion sufficiently for allowing a coupler 112 of the drillstring 111 to pass through the drillstring bore 112.

Preferably, the support structure 106 is made from steel and the stripper rubber body 102 is made from an elastomeric material (e.g., synthetic rubber, nitrile, EPDM rubber or any other suitable natural and/or synthetic resilient material). The support structure 106 includes a mechanical bonding portion 114 (FIG. 2) and means for allowing attachment to well drilling equipment. The support structure engaging portion 108 of the stripper rubber body 102 is formed over the mechanical bonding portion 114. Preferably, the mechanical bonding portion 114 includes one or more features that enhance the mechanical interface between the stripper rubber body material and the support structure 110. Examples of the mechanical interface enhancing features include undercuts, windows, passages and the like. In addition to mechanical interface enhancing features, it is also known to coat all or a portion of an insert with a bonding agent that enhances adhesion between the stripper rubber body 102 and the support structure 106.

Engagement pins 116, which are fixedly attached to the support structure 110, are one embodiment of a means for allowing attachment to well drilling equipment (e.g., via a cam lock adapter ring as disclosed in U.S. Pat. No. 7,174,956). The term "pin" is disclosed herein to be broadly construed to include any suitable engagement member configuration for carrying out the intended functionality. It is disclosed herein that the support structure 106 can be configured in any suitable manner for allowing attachment to associated well drilling equipment (e.g., threaded fastener holes, a threaded central opening, etc). More specifically, a reinforced stripper rubber assembly in accordance with an embodiment of the present invention is not unnecessarily limited to being attachable to associated well drilling equipment by any particular means.

The drillstring bore 112 extends axially through a drillstring engaging portion 118 of the stripper rubber body 102. The drillstring engaging portion 118 is made from an elastomeric material of a first composition (e.g., synthetic rubber, nitrile, EPDM rubber or any other suitable natural and/or synthetic resilient material) and has an inner surface 120 that engages the drillstring 111 when the drillstring 111 is dispose within the drillstring bore 112. A reinforcing insert receiving recess 122 is provided within an exterior surface 124 of the drillstring engaging portion 118 extending entirely around the drillstring bore 112. It is disclosed herein that, in one or more alternate embodiments of the present invention, the reinforcing insert receiving recess 122 can extend partially around the drillstring bore 112 such as the case where a plurality of identically shaped reinforcing insert receiving recesses are uniformly spaced around the drillstring bore 112. As shown in FIG. 2, the reinforcing insert receiving recess 122 has an open end exposed at the exterior surface 124 and has a closed end located between the inner and exterior surfaces (120, 124) of the drill pipe engaging portion 118. It is disclosed herein that the reinforcing insert receiving recess 122 does not extend entirely through the drill pipe engaging portion 118.

The reinforcing insert 104 is disposed within the reinforcing insert receiving recess 122 such that the reinforcing insert receiving recess 122 is substantially filled by the reinforcing insert 104. The reinforcing insert 104 includes an elastomeric material bonded to the stripper rubber body 102 within the reinforcing insert receiving recess 122. As will be discussed below in greater detail, the elastomeric material from which the reinforcing insert can be of the same composition as that of the stripper rubber body 102 or can be of a different composition as that of the stripper rubber body 102.

In one embodiment, the elastomeric material of the drillstring engaging portion 118 (e.g., the entire stripper rubber body 102) is of a first composition, the elastomeric material of the reinforcing insert 104 is of a second composition, and the second elastomeric material composition exhibits substantially different material properties than the first elastomeric material composition. For example, the second elastomeric material composition can be configured to exhibit substantially greater unit strength (e.g., bulk modulus, shear strength, compressive strength and/or tensile strength) than the first elastomeric material composition. Such substantially greater unit strength can be achieved by filling an elastomeric material (i.e., the same elastomeric material from which the stripper rubber body is made) with chopped fibers, non-woven strands and/or non-woven lengths of fiberglass, Aramid (i.e., nylon), metal (e.g., steel), cotton and/or other known reinforcing fibers. Alternatively, a non-filled elastomeric material offering substantially greater unit strength than that of the first elastomeric material composition can be used in making the reinforcing insert 104. In this manner, presence, placement, shape and/or size of the reinforcing insert 104 serve to limit inward deflection of the drillstring engaging portion 118 when fluid pressure is exerted on the an exterior surface of the stripper rubber body structure (i.e., stripper rubber body with integral reinforcing member).

Figure 3:
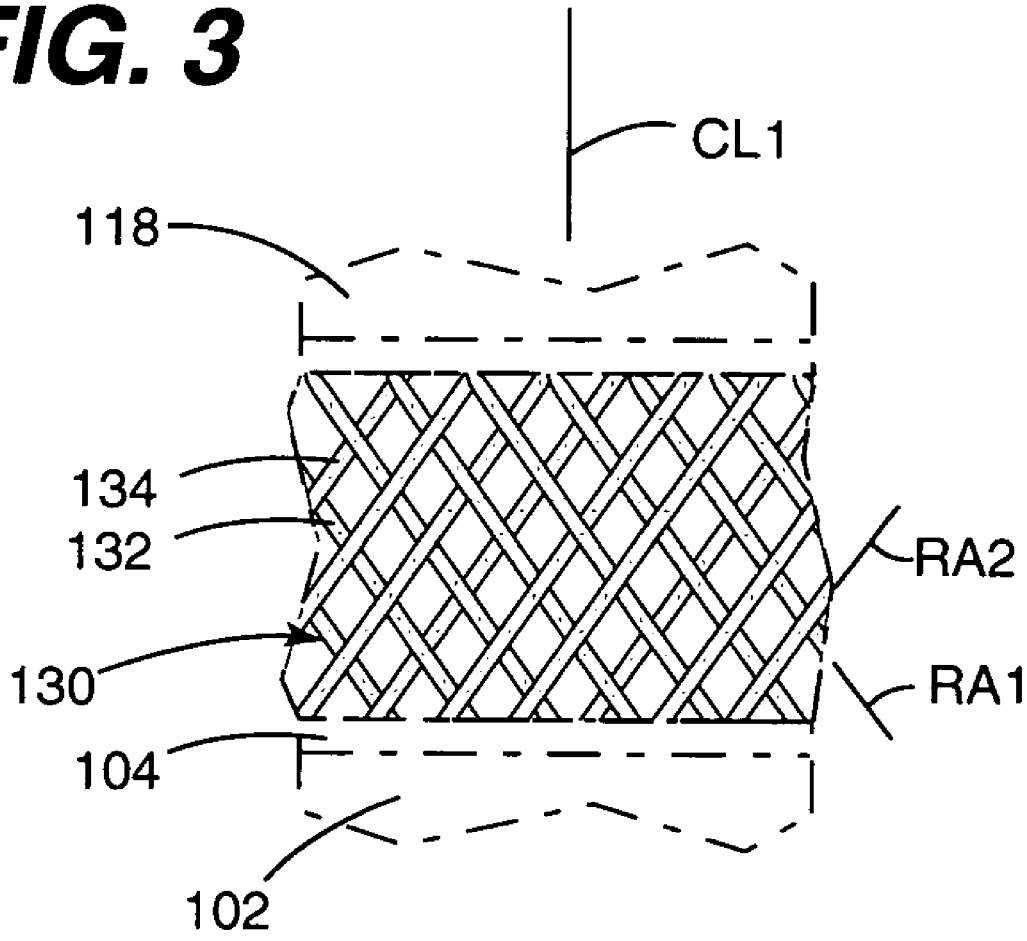
FIG. 3 is an illustrative view showing alignment of a woven material encapsulated within a reinforcing insert in accordance with an embodiment of the present invention.

Referring now to FIGS. 2 and 3, it is disclosed herein that the reinforcing insert 104 can include one or more elongated lengths of a woven material 130 encapsulated within the elastomeric material of the reinforcing insert 104. Examples of such woven materials include, but are not limited to, cloths woven from fiberglass, Aramid, steel, cotton and/or other known cloth forming materials. The woven material 130 can be placed in raw form into the reinforcing insert receiving recess 122 in combination with one or more layers of the second elastomeric material composition or the woven material 130 can impregnated/coated with the second elastomeric material composition and that coated woven material subsequently placed into the reinforcing insert receiving recess 122.

In such implementations, orientation of the threads of the woven material can be important to assuring ability of the drillstring engaging portion 118 to adequately expand when a drillstring passes through the drillstring bore 112. To this end, in one embodiment, the woven material 130 includes a first plurality of threads 132 extending generally along a first reference axis RA1 and a second plurality of threads 134 extending generally along a second reference axis RA2. The reference axes (RA1, RA2) are substantially non-parallel to each other and the reference axes (RA1, RA2) are substantially non-parallel (i.e., at a 45 degree angle) to a centerline axis CL1 of the drillstring bore 112.

Discussed now is a first method for making a reinforced stripper rubber assembly in accordance with an embodiment of the present invention such as, for example, the stripper rubber assembly 100 discussed above. An operation is performed for molding a stripper rubber body from an elastomeric material within a first stripper rubber body mold. Such molding of the stripper rubber body includes forming the reinforcing insert receiving recess to have an open end exposed at the exterior surface and has a closed end located between said inner and exterior surfaces of the drill pipe engaging portion. Such molding of the stripper rubber body further includes forming a drillstring engaging portion having a drillstring bore extending axially therethrough, having a reinforcing insert receiving recess within an exterior surface thereof extending entirely around the drillstring bore and having an inner surface that engages a drillstring when the drillstring is dispose within the drillstring bore. It is disclosed herein that the stripper rubber body can be formed without a reinforcing insert receiving recess and the reinforcing insert receiving recess subsequently formed in the stripper rubber body (e.g., via machining). After removing the stripper rubber body from the first stripper rubber body mold, an operation is performed for filling the reinforcing insert receiving recess with an elastomeric material and, optionally, one or more lengths of a woven material. Thereafter, an operation is performed for situating the stripper rubber body in a second stripper rubber body mold (e.g., under pressure and/or close confinement) such that the stripper rubber body and the elastomeric material disposed in the reinforcing insert receiving recess are jointly contained within a mold cavity, thereof having a shape corresponding to a finished shape of the reinforced stripper rubber body structure (i.e., stripper rubber body with integral reinforcing member). After situation the stripper rubber body in the second stripper rubber body mold, an operation is performed for heating the second stripper rubber body mold to cause the elastomeric material within the reinforcing insert receiving recess to become bonded to the elastomeric material of the stripper rubber body thereby providing a reinforcing insert bonded to the stripper rubber body within the reinforcing insert receiving recess.

A second method for making a reinforced stripper rubber assembly in accordance with an embodiment of the present invention such as, for example, the stripper rubber assembly 100 discussed above is performed using a compression wrap operation as opposed to the second mold discussed above. This method includes forming a stripper rubber body made from an elastomeric material, which can include molding the stripper rubber body or formed in a wrapped lay-up manner (i.e., wrapping of layers of the first elastomeric material composition around a mandrel) and, optionally can include machining the reinforcing insert receiving recess in the stripper rubber body prior to or after curing of wrapped layers of the first elastomeric material composition. The stripper rubber body includes a drillstring engaging portion having a drillstring bore extending axially therethrough, having a reinforcing insert receiving recess within an exterior surface thereof extending entirely around the drillstring bore and having an inner surface that engages a drillstring when the drillstring is dispose within the drillstring bore. An operation is then performed for filling the reinforcing insert receiving recess with an elastomeric material. Thereafter an operation is performed for wrapping a compression inducing material around the exterior surface of the stripper rubber body and around the elastic material within the reinforcing insert receiving recess, followed by performed an operation for heating the wrapped stripper rubber body.

Forming the stripper rubber body can includes forming the reinforcing insert receiving recess to have an open end exposed at the exterior surface and has a closed end located between said inner and exterior surfaces of the drill pipe engaging portion. Filling the reinforcing insert receiving recess with the elastomeric material can include providing a woven material within the reinforcing insert receiving recess. In one embodiment, the elastomeric material of the stripper rubber body is of a first composition, the elastomeric material of the reinforcing insert is of a second composition, and the second elastomeric material composition exhibits substantially different material properties than said first elastomeric material composition. The second elastomeric material composition can exhibit substantially greater unit strength than said first elastomeric material composition. Forming the stripper rubber body can include forming the reinforcing insert receiving recess to have an open end exposed at the exterior surface and has a closed end located between said inner and exterior surfaces of the drill pipe engaging portion. Optionally, filling the reinforcing insert receiving recess with the elastomeric material can include providing a woven material within the reinforcing insert receiving recess whereby the woven material can include a first plurality of threads extending generally along a first reference axis and a second plurality of threads extending generally along a second reference axis with the reference axes being substantially non-parallel to each other and the reference axes being substantially non-parallel to a centerline axis of the drillstring bore.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in all its aspects. Although the invention has been described with reference to particular means, materials and embodiments, the invention is not intended to be limited to the particulars disclosed; rather, the invention extends to all functionally equivalent technologies, structures, methods and uses such as are within the scope of the appended claims.

What is claimed is:

1. A method for making a reinforced stripper rubber assembly, comprising:

molding a stripper rubber body from an elastomeric material of a first composition within a first stripper rubber body mold, wherein molding the stripper rubber body includes forming a drillstring engaging portion having a drillstring bore extending axially therethrough, having a reinforcing insert receiving recess within an, exterior surface thereof extending entirely around the drillstring bore and having an inner surface that engages a drillstring when the drillstring is dispose within the drillstring bore and wherein an entire portion of the drillstring bore is defined by said first composition elastomeric material;

filling the reinforcing insert receiving recess with a single reinforcing insert after removing the stripper rubber body from the first stripper rubber body mold, wherein the single reinforcing insert includes an elastomeric material of a second composition exhibiting substantially different material properties than said first elastomeric material composition and a plurality of lengths of woven material encapsulated within the elastomeric material thereof, wherein said second composition elastomeric material of the single reinforcing insert extends entirely around the drillstring bore, wherein said second composition elastomeric material of the reinforcing insert is exposed at an exterior face of the stripper rubber body around an entire outer circumference thereof, and wherein the elastomeric material of the first composition extends to the exterior face of the stripper rubber body above and below the single reinforcing insert;

situating the stripper rubber body in a second stripper rubber body mold such that the stripper rubber body and the elastomeric material disposed in the reinforcing insert receiving recess are jointly contained within a mold cavity thereof having a shape corresponding to a finished shape of the reinforced stripper rubber body; and heating the second stripper rubber body mold after situation the stripper rubber body therein to cause the elastomeric material of the second composition to become bonded to the elastomeric material of the second composition thereby providing a reinforcing insert bonded to the stripper rubber body within the reinforcing insert receiving recess.

2. The method of claim 1 wherein forming the stripper rubber body includes forming the reinforcing insert receiving recess to have an open end exposed at the exterior surface and has a closed end located between said inner and exterior surfaces of the drill pipe engaging portion.

3. The method of claim 1 wherein:

filling the reinforcing insert receiving recess with the single reinforcing insert includes aligning threads of said woven material elastomeric to be substantially skewed with respect to a centerline axis of the drillstring bore;

said threads each extend generally along one of a first reference axis and a second reference axis; and the first reference axis is skewed with respect to the second reference axis.

4. The method of claim 1 wherein:

filling the reinforcing insert receiving recess with the single reinforcing insert includes wrapping at least one length of said woven material around the drillstring bore within the reinforcing insert receiving recess; and said at least one length of woven material is one of impregnated with and coated with said second elastomeric material composition.

5. The method of claim 4 wherein:

filling the reinforcing insert receiving recess with the single reinforcing insert includes aligning threads of said woven material elastomeric to be substantially non-parallel with respect to a centerline axis of the drillstring bore;

said threads each extend generally along one of a first reference axis and a second reference axis; and the first reference axis is skewed with respect to the second reference axis.

6. The method of claim 1 wherein said second elastomeric material composition exhibits substantially greater unit strength than said first elastomeric material composition.

7. The method of claim 1 wherein:

forming the stripper rubber body includes forming the reinforcing insert receiving recess to have an open end exposed at the exterior surface and has a closed end located between said inner and exterior surfaces of the drill pipe engaging portion;

filling the reinforcing insert receiving recess with the single reinforcing insert includes wrapping at least one length of said woven material around the drillstring bore within the reinforcing insert receiving recess; and said at least one length of woven material is one of impregnated with and coated with said second elastomeric material composition;

said woven material includes a plurality of threads each extending generally along one of a first reference axis and a second reference axis;

said reference axes are substantially non-parallel to each other; and said reference axes are substantially non-parallel to a centerline axis of the drillstring bore.

8. A method for making a reinforced stripper rubber assembly, comprising:

forming a stripper rubber body made from an elastomeric material of a first composition, wherein the stripper rubber body includes a drillstring engaging portion having a drillstring bore extending axially therethrough, having a reinforcing insert receiving recess within an exterior surface thereof extending entirely around the drillstring bore and having an inner surface that engages a drillstring when the drillstring is dispose within the drillstring bore and wherein, an entire portion of the drillstring bore is defined by said first composition elastomeric material;

filling the reinforcing insert receiving recess with a single reinforcing insert after forming the stripper rubber body, wherein the single reinforcing insert includes an elastomeric material of a second composition exhibiting substantially different material properties than said first elastomeric material composition and a plurality of lengths of woven material encapsulated within the elastomeric material thereof, wherein said second composition elastomeric material of the single reinforcing insert extends entirely around the drillstring bore, wherein said second composition elastomeric material of the reinforcing insert is exposed at an exterior face of the stripper rubber body around an entire outer circumference thereof, and wherein the elastomeric material of the first composition extends to the exterior face of the stripper rubber body above and below the single reinforcing insert;

wrapping a compression inducing material around the exterior surface of the stripper rubber body and the elastic material within the reinforcing insert receiving recess; and heating said wrapped stripper rubber body for causing the elastomeric material of the second composition to become bonded to the elastomeric material of the first composition.

9. The method of claim 8 wherein forming the stripper rubber body includes forming the reinforcing insert receiving recess to have an open end exposed at the exterior surface and has a closed end located between said inner and exterior surfaces of the drill pipe engaging portion.

10. The method of claim 8 wherein:

filling the reinforcing insert receiving recess with the single reinforcing insert includes aligning threads of said woven material elastomeric to be substantially skewed with respect to a centerline axis of the drillstring bore;

said threads each extend generally along one of a first reference axis and a second reference axis; and the first reference axis is skewed with respect to the second reference axis.

11. The method of claim 8 wherein:

filling the reinforcing insert receiving recess with the single reinforcing insert includes wrapping at least one length of said woven material around the drillstring bore within the reinforcing insert receiving recess; and said at least one length of woven material is one of impregnated with and coated with said second elastomeric material composition.

12. The method of claim 11 wherein:

filling the reinforcing insert receiving recess with the single reinforcing insert includes aligning threads of said woven material elastomeric to be substantially non-parallel with respect to a centerline axis of the drillstring bore;

said threads each extend generally along one of a first reference axis and a second reference axis; and the first reference axis is skewed with respect to the second reference axis.

13. The method of claim 8 wherein said second elastomeric material composition exhibits substantially greater unit strength than said first elastomeric material composition.

14. The method of claim 8 wherein:

forming the stripper rubber body includes forming the reinforcing insert receiving recess to have an open end exposed at the exterior surface and has a closed end located between said inner and exterior surfaces of the drill pipe engaging portion;

filling the reinforcing insert receiving recess with the single reinforcing insert includes wrapping at least one length of said woven material around the drillstring bore within the reinforcing insert receiving recess; and said at least one length of woven material is one of impregnated with and coated with said second elastomeric material composition;

said woven material includes a plurality of threads each extending generally along one of a first reference axis and a second reference axis;

said reference axes are substantially non-parallel to each other; and said reference axes are substantially non-parallel to a centerline axis of the drillstring bore.

15. A method for making a reinforced stripper rubber assembly, comprising:

providing a stripper rubber body made from an elastomeric material of a first composition, wherein the stripper rubber body includes a drillstring engaging portion having a drillstring bore extending axially therethrough, having a reinforcing insert receiving recess within an exterior surface thereof extending entirely around the drillstring bore and having an inner surface that engages a drillstring when the drillstring is dispose within the drillstring bore and wherein an entire portion of the drillstring bore is defined by said first composition elastomeric material;

filling the reinforcing insert receiving recess with a single reinforcing insert after forming the stripper rubber body, wherein the single reinforcing insert includes an elastomeric material of a second composition exhibiting substantially different material properties than said first elastomeric material composition and a plurality of lengths of woven material encapsulated within the elastomeric material thereof, wherein said second composition elastomeric material of the single reinforcing insert extends entirely around the drillstring bore, wherein said second composition elastomeric material of the reinforcing insert is exposed at an exterior face of the stripper rubber body around an entire outer circumference thereof, and wherein the elastomeric material of the first composition extends to the exterior face of the stripper rubber body above and below the single reinforcing insert;

applying heat to the stripper rubber body and the single reinforcing insert for causing the elastomeric material of the second composition to become bonded to the elastomeric material of the first composition.

16. The method of claim 15 wherein forming the stripper rubber body includes forming the reinforcing insert receiving recess to have an open end exposed at the exterior surface and has a closed end located between said inner and exterior surfaces of the drill pipe engaging portion.

17. The method of claim 8 wherein:

filling the reinforcing insert receiving recess with the single reinforcing insert includes aligning threads of said woven material elastomeric to be substantially skewed with respect to a centerline axis of the drillstring bore;

said threads each extend generally along one of a first reference axis and a second reference axis; and the first reference axis is skewed with respect to the second reference axis.

18. The method of claim 15 wherein:

filling the reinforcing insert receiving recess with the single reinforcing insert includes wrapping at least one length of said woven material around the drillstring bore within the reinforcing insert receiving recess; and said at least one length of woven material is one of impregnated with and coated with said second elastomeric material composition.

19. The method of claim 17 wherein:

filling the reinforcing insert receiving recess with the single reinforcing insert includes aligning threads of said woven material elastomeric to be substantially non-parallel with respect to a centerline axis of the drillstring bore;

said threads each extend generally along one of a first reference axis and a second reference axis; and the first reference axis is skewed with respect to the second reference axis.

20. The method of claim 15 wherein said second elastomeric material composition exhibits substantially greater unit strength than said first elastomeric material composition.

* * * * *